US009206566B2

(12) United States Patent
Killion

(10) Patent No.: US 9,206,566 B2
(45) Date of Patent: Dec. 8, 2015

(54) AUTOMATIC FOUR LEG LEVELING FOR COLD PLANERS

(71) Applicant: Caterpillar Paving Products Inc., Minneapolis, MN (US)

(72) Inventor: Daniel H. Killion, Blaine, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 14/299,442

(22) Filed: Jun. 9, 2014

(65) Prior Publication Data

US 2014/0308075 A1 Oct. 16, 2014

Related U.S. Application Data

(62) Division of application No. 13/334,187, filed on Dec. 22, 2011, now Pat. No. 8,874,325.

(51) Int. Cl.

| | |
|---|---|
| ***G06F 7/70*** | (2006.01) |
| ***E21C 35/08*** | (2006.01) |
| ***E01C 23/08*** | (2006.01) |
| ***E01C 23/088*** | (2006.01) |

(52) U.S. Cl.
CPC ..... *E01C 23/088* (2013.01)

(58) Field of Classification Search
USPC ..... 701/50; 299/1.5; 404/90
See application file for complete search history.

(56) References Cited

U.S. PATENT DOCUMENTS

| | | | | |
|---|---|---|---|---|
| 5,309,407 | A | 5/1994 | Sehr et al. | |
| 5,768,973 | A | 6/1998 | Cochran | |
| 5,984,420 | A * | 11/1999 | Murray et al. | 299/1.5 |
| 6,033,031 | A * | 3/2000 | Campbell | 299/39.1 |
| 7,047,735 | B2 | 5/2006 | Sprinkle et al. | |
| 7,285,072 | B2 | 10/2007 | Williams | |
| 7,828,309 | B2 | 11/2010 | Bering et al. | |
| 8,260,508 | B2 | 9/2012 | Price et al. | |
| 8,364,356 | B2 | 1/2013 | Young et al. | |
| 8,874,325 | B2 * | 10/2014 | Killion | 701/50 |
| 2008/0129103 | A1 * | 6/2008 | Hall et al. | 299/39.2 |
| 2008/0267706 | A1 * | 10/2008 | Hall et al. | 404/90 |
| 2009/0052987 | A1 * | 2/2009 | Hall et al. | 404/90 |
| 2009/0108663 | A1 * | 4/2009 | Berning et al. | 299/1.5 |
| 2010/0109422 | A1 | 5/2010 | Busley et al. | |
| 2013/0030667 | A1 | 1/2013 | Fujimoto et al. | |
| 2013/0162004 | A1 * | 6/2013 | Killion | 299/1.5 |
| 2013/0166155 | A1 * | 6/2013 | Killion | 701/50 |
| 2013/0173138 | A1 | 7/2013 | Vasichek | |
| 2014/0308075 | A1 * | 10/2014 | Killion | 404/84.05 |

FOREIGN PATENT DOCUMENTS

| | | | |
|---|---|---|---|
| EP | 1154075 | A2 | 11/2001 |
| JP | 1989062505 | A2 | 3/1989 |

* cited by examiner

*Primary Examiner* — Thomas G Black
*Assistant Examiner* — Tyler Paige
(74) *Attorney, Agent, or Firm* — Miller, Matthias & Hull LLP

(57) ABSTRACT

A method for leveling of a machine on a surface, and a machine for the same, is disclosed. The method may comprise equalizing the legs of the machine prior to extending or retracting the legs of the machine to raise or lower the machine during non-milling operational status. The method may also comprise extending or retracting the legs during milling operational status while maintaining the relative lengths of each leg.

8 Claims, 6 Drawing Sheets

AUTOMATIC FOUR LEG LEVELING FOR COLD PLANERS

CROSS-REFERENCE TO RELATED APPLICATIONS

This is a divisional application under 35 USC §121 of U.S. Ser. No. 13/334,187 filed on Dec. 22, 2011.

TECHNICAL FIELD

The present disclosure generally relates to machines for the treatment of roadway surfaces, and more particularly to a road planer for roadway surfacing operations.

BACKGROUND

Road milling machines, also known as cold planers, may be configured to scarify, remove, mix, or reclaim material from the surface of bituminous, concrete, or asphalt roadways and other surfaces using a rotatable planing tool mounted on a frame. The frame may be mounted on a plurality of tracks or wheels which support and transport the machine along the roadway surface.

Typically, cold planers may also include a plurality of lifting members positioned near the front and rear of the frame. The lifting members may be adjusted between extended and retracted positions to control the depth and shape of a cut by raising or lowering the frame and rotatable planning tool.

U.S. Publication No. 2009/0108663 ("Berning et al.") published Apr. 30, 2009 is an example of prior art related to positioning a road milling machine relative to the surface. While Berning et al. discusses controlling the leveling of a machine with the ground, Berning does not account for the operational status of the machine while leveling. A design is needed that automatically takes into account the operational status of the machine when leveling.

It will be appreciated that this background section is created by the inventors as an aid to the reader, and is not intended as a formal discussion of art or prior art. Moreover, the observations of the inventors regarding technical problems do not indicate or imply that knowledge of such problems existed in the art.

SUMMARY OF THE DISCLOSURE

In accordance with one aspect of the disclosure, a method of controlling the leveling of a machine on a surface is disclosed. The machine may include a frame supported by a plurality of legs. The method may comprise receiving by a controller a raise signal during non-milling operational status to extend the plurality of legs, determining the maximum initial leg length in the plurality of legs, substantially leveling the frame with respect to the surface by extending some of the plurality of legs to the maximum initial leg length, and further extending the plurality of legs to an extension length that is greater than the maximum initial leg length.

In accordance with another aspect of the disclosure, another method of controlling the leveling of a machine on a surface disclosed. The machine may include a frame supported by a plurality of legs and at least one sideplate mounted to the frame. The plurality of legs may include first and second front legs and first and second rear legs. The method may comprise receiving by a controller a first lower signal during non-milling operations to retract the plurality of legs, determining the minimum initial leg length in the plurality of legs, substantially leveling the machine with respect to the surface by retracting some of the plurality of legs to the minimum initial leg length, and further retracting all of the plurality of legs to a retraction length that is less than the minimum initial leg length.

In accordance with another aspect of the disclosure, a method of controlling the vertical position of a cold planer is disclosed. The cold planer may include a plurality of legs, and a tool disposed in an initial grade and initial slope configuration on a surface. The method may comprise receiving by a controller a raise signal during milling operational status to extend the plurality of legs, and maintaining the relative length of the legs to each other while extending the legs at the same rate from a first position to a second position.

In accordance with a further aspect of the disclosure, a machine for road work is disclosed. The machine may comprise a frame, a plurality of ground engaging units, a plurality of vertically moveable legs, and a controller. Each leg may connect one of the plurality of ground engaging units to the frame. The controller may be configured to, in response to a first signal received during non-milling machine operational status, activate some of the plurality of legs to move to a first length and then to activate all of the plurality of legs to move at the same rate to a second length. The controller may be further configured to, upon receipt of a raise signal during milling operational status, extend all of the legs at the same rate from a first position to a second position and, upon receipt of a lower signal, to lower all of the legs at the same rate from the second position to the first position.

DETAILED DESCRIPTION

Figure 1:
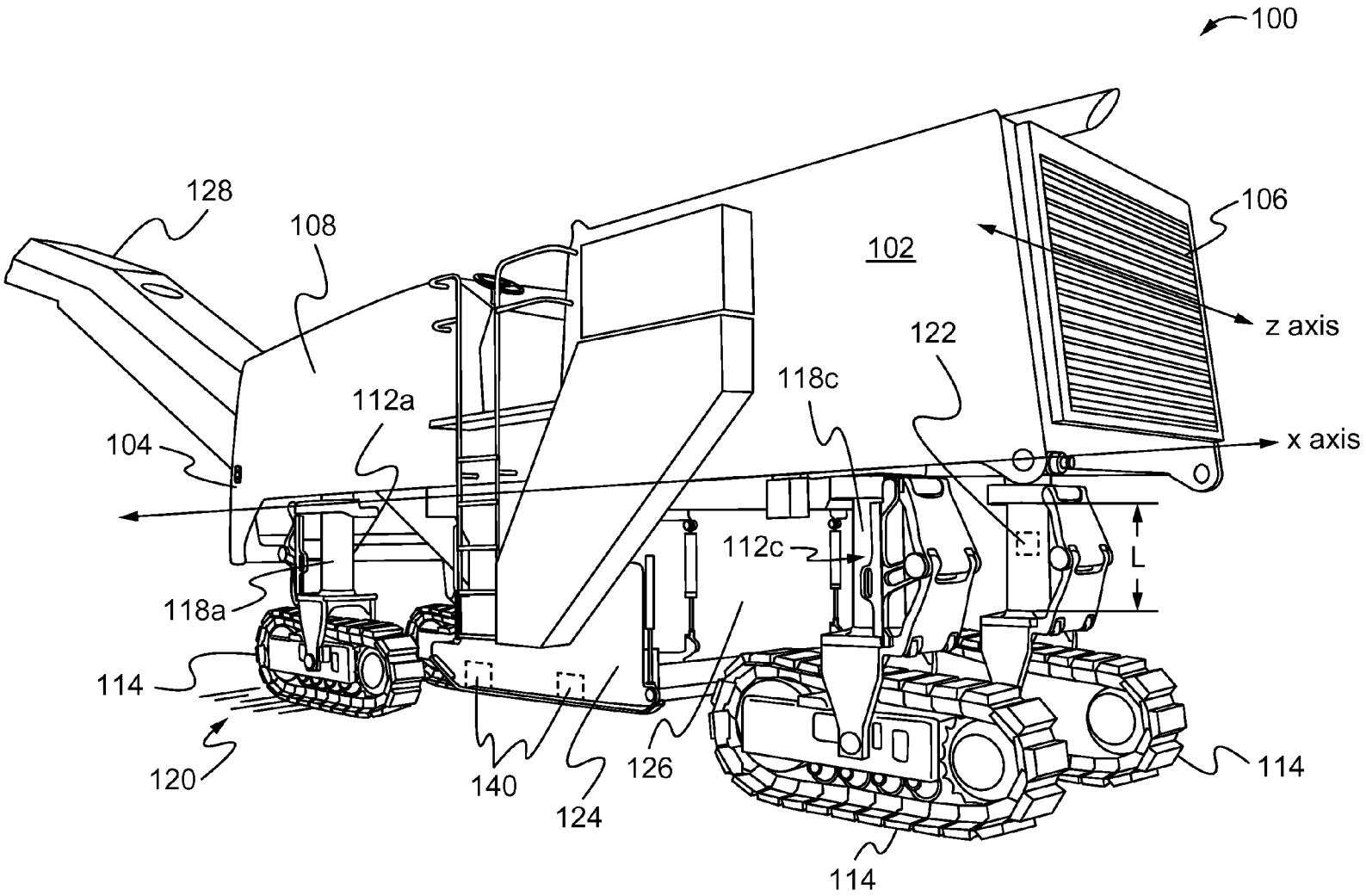
FIG. 1 is a perspective view of an exemplary machine in accordance with the teachings of this disclosure.
Figure 2:
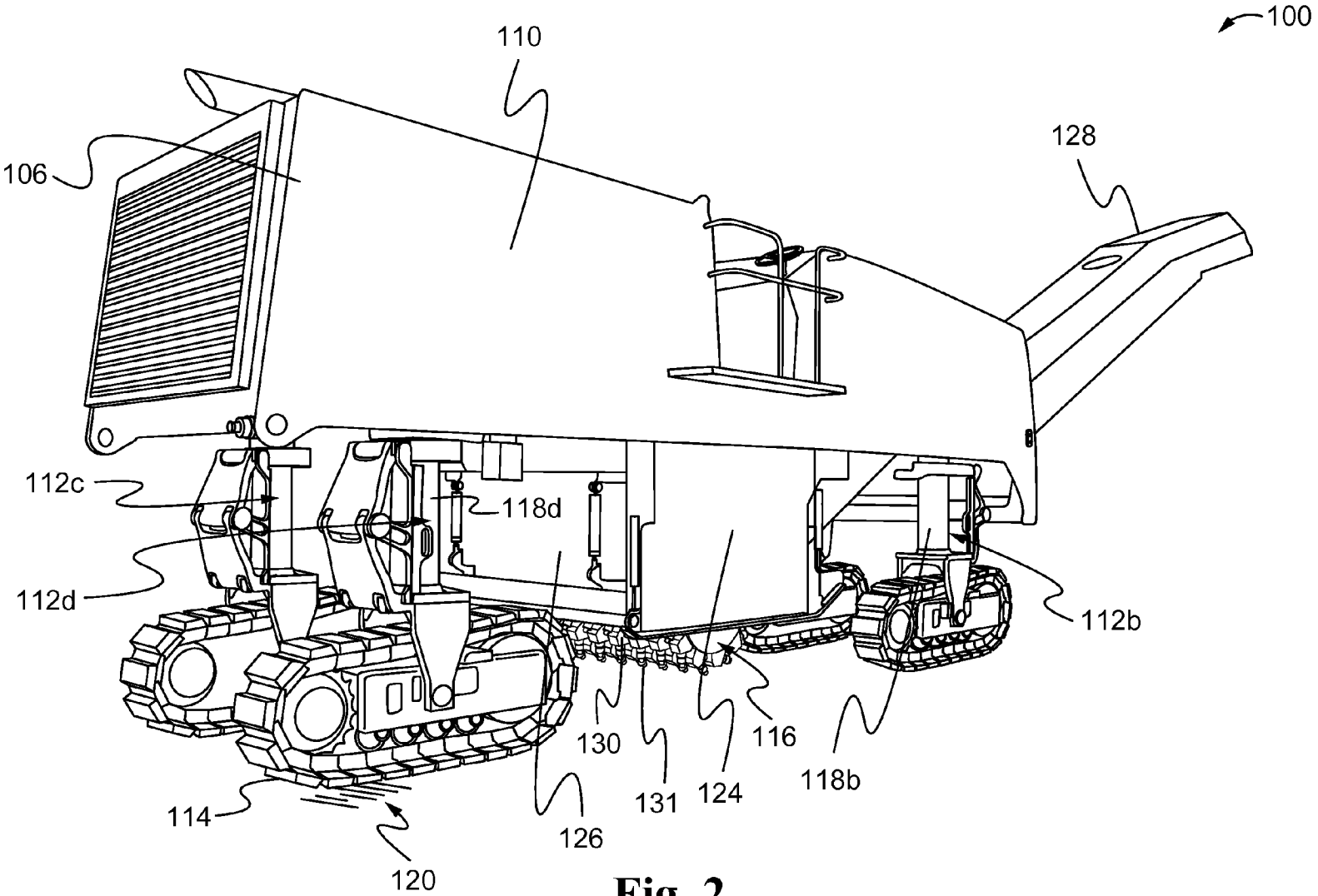
FIG. 2 is another perspective view of the exemplary machine of FIG. 1.
Figure 3:
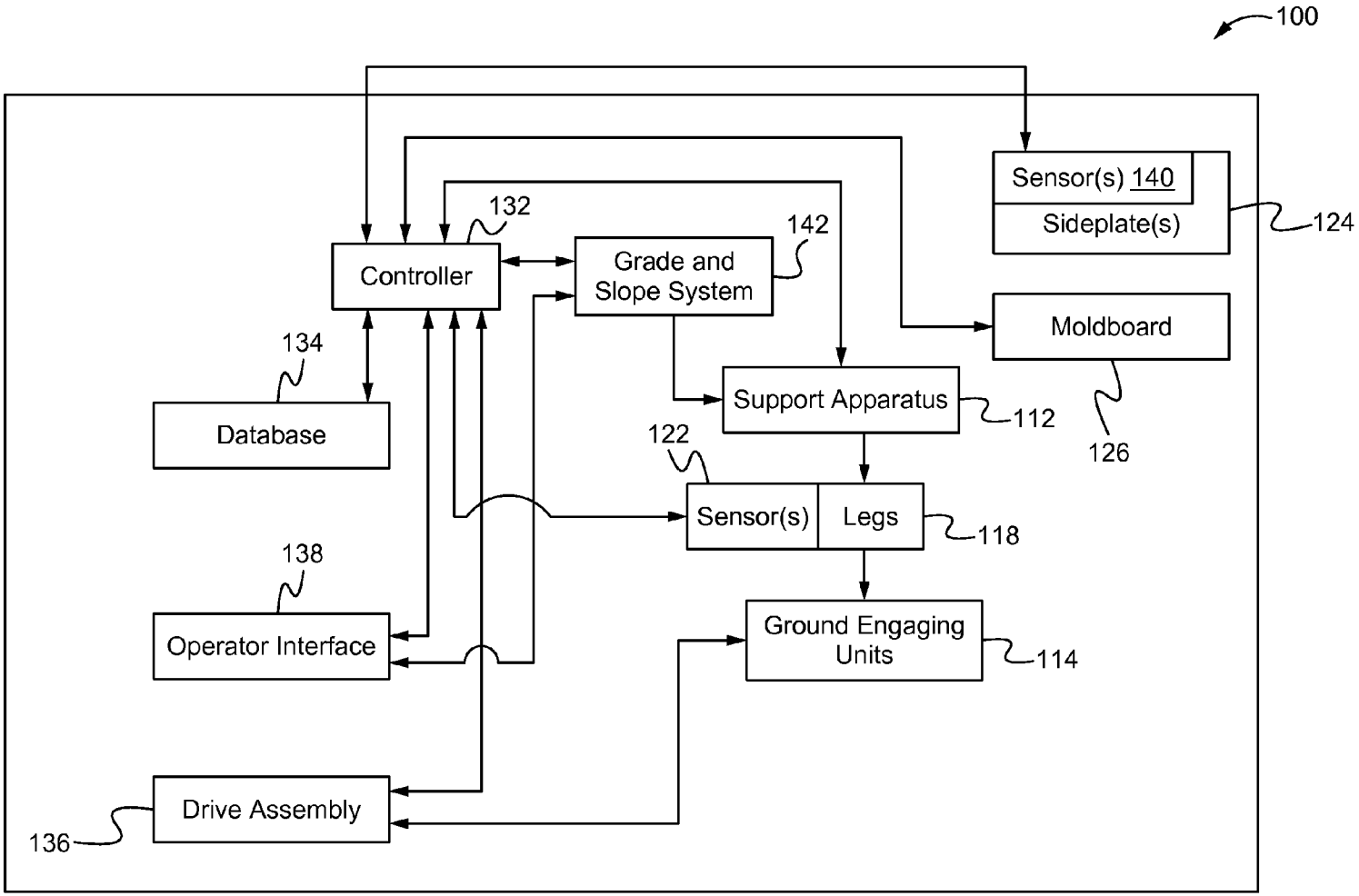
FIG. 3 is a general schematic view of an exemplary embodiment of a portion of a machine in accordance with the teachings of this disclosure.

Machines may be configured to perform operations at job sites. Examples of such machines include cold planers, paving machines, on and off highway vehicles, construction equipment, earth-moving equipment and so on. While the teachings of this disclosure are not limited to a particular type of machine, an exemplary machine 100, a cold planer, is shown in FIGS. 1-3 and discussed below to illustrate the teachings of this disclosure. The exemplary machine 100, a cold planer, may be configured to scarify, remove, mix, or reclaim material from the surface of bituminous, concrete, or asphalt roadways and other surfaces. Elements of the cold planer 100 may include a frame 102, support apparatus 112, a plurality of ground engaging units 114 and a tool 116. The frame 102 may include a front end 104, a rear end 106, a first side 108 and a second side 110.

In an embodiment, there may be a plurality of support apparatus 112. Some of the plurality of support apparatus (referred to herein as the "front support apparatus" 112*a*) may be disposed proximal to the front end 104 of the frame 102 and some of the plurality of support apparatus (referred to herein as the "rear support apparatus") may be disposed proximal to the rear end 106 of the cold planer 100. In the embodiment illustrated in FIGS. 1-2 there are two front support apparatus 112*a* disposed on opposite sides of the front end 104 of the frame 102 and two rear support apparatus 112*b* disposed on opposite sides of the rear end 106 of the frame 102.

The support apparatus 112 may be configured to support frame 102 on a surface 120. Each support apparatus 112 may include a leg 118. A leg position sensor 122 may be disposed on, inside, or adjacent each leg 118. Each leg position sensor 122 may provide to one or more controllers 132 (see FIG. 3) of the cold planer 100 information on the length L of the leg or the amount of extension or the amount of retraction of the leg 118. Other sensors may be disposed on the frame for sensing other parameters. In the embodiment illustrated in FIGS. 1-2 there are two front legs 118*a*, 118*b* and two rear legs 118*c*, 118*d*. The two front legs 118*a*, 118*b* are disposed on opposite sides of the front end 104 of the frame 102. The two rear legs 118*c*, 118*d* are disposed on opposite sides of the rear end 106 of the frame 102.

Ground engaging units 114 may perform the function of transporting the cold planer 100 across a surface 120. Ground engaging units 114 may include tracks, wheels, and/or other known traction devices suitable for use on mobile machines. At least one ground engaging unit 114 may be powered by a machine drive assembly 136 (see FIG. 3) for forward and rearward movement of cold planer 100. An example of a drive assembly 136 includes an internal combustion engine or a hydraulic motor. It is further contemplated that ground engaging units 114 may be coupled to frame 102 by the legs 118.

Legs 118 may be vertically moveable. As such, the legs 118 may be extended to cause upward movement of the frame 102 with respect to the surface 120 on which the cold planer 100 is disposed and may be retracted to cause downward movement of frame 102 with respect to surface 120. In one embodiment, the legs 118 may be columns that include telescoping portions (not shown), such as, for example, overlapping cylindrical segments adapted to slide inward (retract) or outward (extend) with respect to each other. The inward and outward sliding of the overlapping cylindrical segments may raise and lower frame 102, and their movement may be actuated by hydraulic pressure.

Frame 102 may also include one or more structural load carrying members adapted to support and/or protect components of cold planer 100. The frame 102 may include one or more sideplates 124 mounted on the sides of the frame 102. In the embodiment illustrated in FIGS. 1-2, the frame 102 has two sideplates 124, each moveable in a generally vertical direction between a raised position and a lowered position. In that embodiment, one of the plurality of sideplates 124 is attached to a first side 106 of the frame 102 and the other sideplate 124 is attached to a second side 108 of the frame 102. FIG. 1 illustrates the sideplate 124 on the first side 108 of the frame 102 in the lowered position. FIG. 2 illustrates the other sideplate 124 on the second side 110 of the frame in the raised position. One or more sideplate sensors 140 may be disposed on each sideplate 124. Each sideplate sensor 140 may provide to controller 132 of the cold planer 100 vertical position information with regard to the sideplates and/or information as to whether a sideplate is in contact with the surface 120.

The frame 102 may also include a moldboard 126 moveable with respect to the rest of the frame 102 in a generally vertical direction between a raised and lowered position. FIG. 1 illustrates the moldboard 126 in a lowered position. FIG. 2 illustrates a moldboard 126 in a raised position.

Other elements of frame 102 may include, for example, housings, beams, and panels. Furthermore, tool 116 may be supported on or within frame 102. In the embodiment illustrated in FIG. 1, the machine 100 also includes a conveyor 128. The sideplate 124 may be configured to lock into the raised position on the frame 102. Similarly, the moldboard 126 may be configured to lock into the raised position on the frame 102.

Tool 116 may include a rotatable planing tool, such as, for example, a rotatable drum 130 or cylinder. Drum 130 may include a plurality of replaceable bits 131 mounted thereon and may be lowered to engage the surface 120. Upon engagement, the bits may cut and remove material from the surface 120. The removed material may enter a conveyor 128 which may transfer the removed material into a dump truck (not shown), or the like, for transport off-site. The height and geometry of drum 130 relative to the surface 120 may determine the shape and depth of cut made in the surface 120 and may affect the amount of material being removed from the surface 120. Thus, in order to control the shape and depth of a cut in the surface, the grade of the drum 130 may be adjusted such that it may vertically move away from, towards, and into surface 120 by extending or retracting the legs 118 of the machine 100. The slope of the drum (and the cut that it makes) may also be adjusted by extending or retracting the legs 118 on one side of the machine 100 to a different length than the legs 118 on the opposite side of the machine 100.

A hydraulic system (not shown) may be configured to direct pressurized hydraulic fluid to cause upward or downward movement of legs 118. The hydraulic system may include a hydraulic circuit for selectively supplying the pressurized hydraulic fluid to different areas of hydraulic system and hydraulic cylinders to convert the hydraulic pressure into mechanical motion for actuating legs 118.

As illustrated in FIG. 3, control of the cold planer 100 may be managed by one or more embedded or integrated controllers 132 of the cold planer 100. The controller 132 may take the form of one or more processors, microprocessors, microcontrollers, electronic control modules (ECMs), electronic control units (ECUs), or any other suitable means for electronically controlling functionality of the cold planer 100.

The controller 132 may be configured to operate according to a predetermined algorithm or set of instructions for controlling the cold planer 100 based on various operating conditions of the cold planer 100. Such an algorithm or set of instructions may be read into an on-board memory of the controller 132, or preprogrammed onto a storage medium or memory accessible by the controller 132, for example, in the form of a floppy disk, hard drive, optical medium, random access memory (RAM), read-only memory (ROM), or any other suitable computer readable storage medium commonly used in the art (each referred to as a "database").

The controller 132 may be in electrical communication or connected to the drive assembly 136, or the like, and various other components, systems or sub systems of the cold planer 100. The drive assembly 136 may comprise an engine or hydraulic motor among other elements. By way of such connection, a controller 132 may receive data pertaining to the current operating parameters of the cold planer 100 from sensors and the like. In response to such input, the controller 132 may perform various determinations and transmit output signals corresponding to the results of such determinations or corresponding to actions that need to be performed.

The controller 132 may include a plurality of input interfaces for receiving information and command signals from various switches and sensors associated with the cold planer 100 and a plurality of output interfaces for sending control signals to various actuators associated with the cold planer 100. Suitably programmed controller 132 may serve many additional similar or wholly disparate functions as is well-known in the art.

With regard to input, the controller 132 may receive signals or data from an operator interface 138, leg position sensors 122, sideplate sensors 140, and the like. As can be seen in the exemplary embodiment illustrated in FIG. 3, the controller 132 may receive signals from an operator interface 138. Such signals received by the controller 132 from the operator interface 138 may include, but are not limited to, an all-leg raise signal and an all-leg lower signal. The controller 132 may also receive position and/or length data from each leg position sensor 122. As noted before, such data may include, but is not limited to, information as to the length L of a leg 118 or the amount of extension or retraction of the leg 118. The controller 132 may also receive data from one or more sideplate sensors 140. Such data may include, but is not limited to, information related to the vertical position of the sideplate 124 and/or whether the sideplate 124 is in contact with the surface 120.

The controller 132 may also receive data from other controllers, a grade and slope system 142 for the machine 100, the operator interface 138, and the like. In one embodiment, another controller may provide information to the controller 132 regarding the operational status of the machine 100. In other embodiments, such information may be provided by the grade and control system 142, or the like, to the controller 132. The operation status received may include whether the cold planer 100 is in non-milling operational status or milling operational status.

In an embodiment, the grade and slope system 142 may receive and process data from the operator interface 138 related to the operator desired depth of the cut, the slope of the cut, and the like. When the machine 100 is in non-milling operational status, the grade and slope system 142 may be in an "off" state. When the machine 100 is in a milling operational status, the grade and slope system may be in an "auto" or "standby" mode.

Signals received by the controller 132 from the operator interface 138 may include, but are not limited to, an all-leg raise signal, and an all-leg lower signal. The controller 132 may also receive data from each leg position sensor 122. As noted before, such data may include information as to the length L of a leg 118 or the amount of extension or retraction of the leg 118. The controller 132 may also receive data from the one or more sideplate sensors 133. Such data may include information related to the vertical position of the sideplate 124 and/or whether the sideplate 124 is in contact with the surface 120.

The controller 132 may also receive data from the grade and slope system 142 or the operator interface 138 as to the operational status of the machine. The operational status received may include whether the cold planer 100 is in milling operational status and whether the grade and slope system 142 is in auto or standby mode. The controller 132 and/or the grade and slope system 142 may also provide information to as to the grade (the depth of the cut) and the slope of the cut to the controller 132.

INDUSTRIAL APPLICABILITY

The present disclosure may find applicability in increasing machine productivity by reducing the amount of time it takes the machine operator to setup and maneuver the machine. An operator may desire a machine 100 such as a cold planer to be level for a variety of reasons. Typically in such machines, each leg must be adjusted individually and checked visually or with instruments to achieve a desired extended or retracted level position. The present disclosure finds applicability in achieving a level condition for the machine 100 quickly and automatically with an input to the operator interface 138. This significantly reduces the amount of time and effort required by the operator to achieve the desired level condition. A level condition may be desired for machine stability during non-milling operations such as loading the machine 100 on and off transportation vehicles, and for machine travel on roadways.

The machine 100 is considered level in the lengthwise direction when the x-axis of the frame 102 front to rear is parallel with the plane of the surface 120 upon which the machine is disposed. The machine 100 is level in the crosswise direction when the z-axis of the frame (left to right) is parallel with the plane of the surface 120. Unless specified, when the machine 100 is referred to as level it means in both the lengthwise and crosswise directions.

The present disclosure also allows the tool 116 to "jump" an object, such as a manhole or sewer, in its milling path with minimal effort on the part of the operator.

Figure 4:
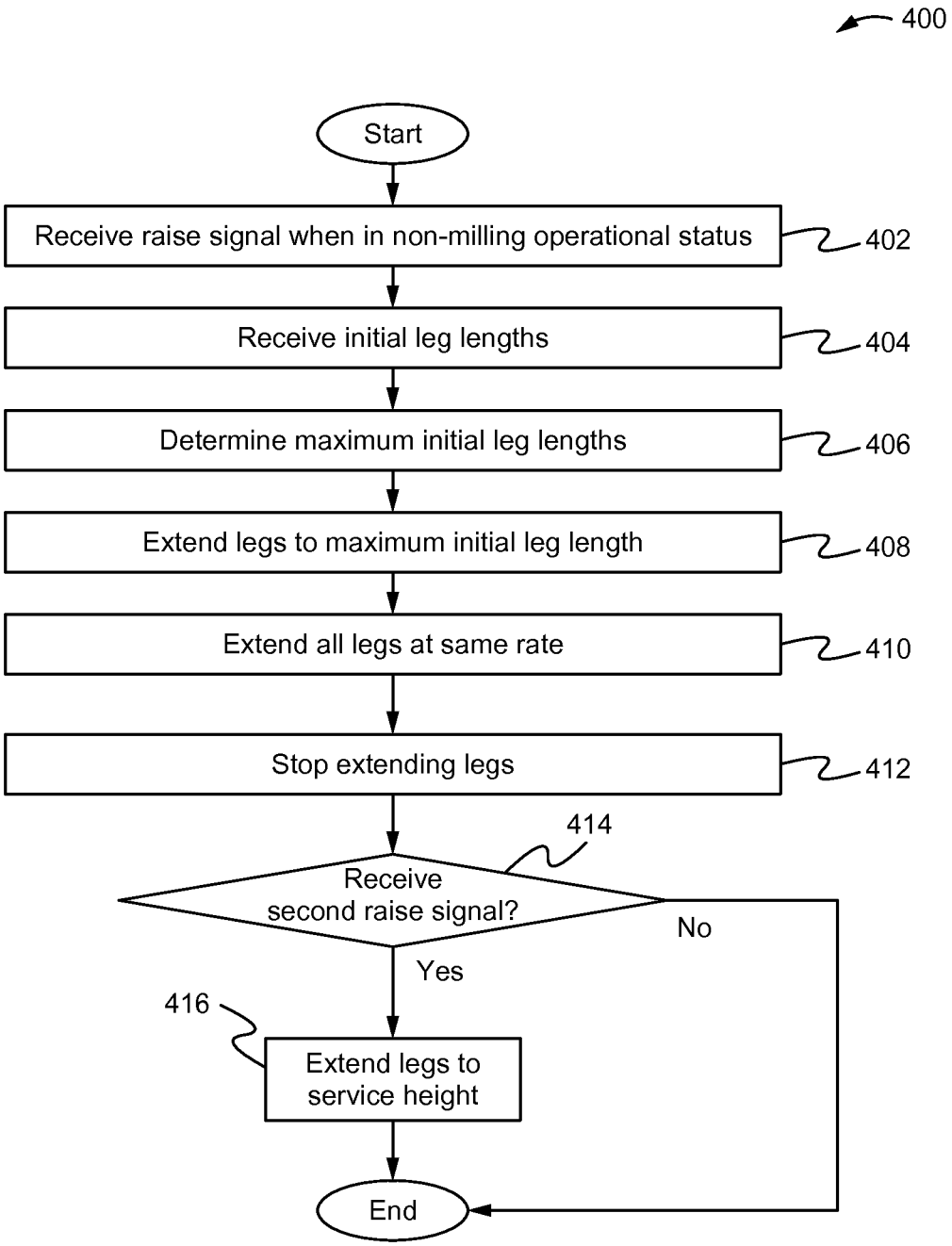
FIG. 4 illustrate an exemplary method for controlling the leveling of a machine on a surface in accordance with an exemplary embodiment.

FIG. 4 is an exemplary method 400 for controlling the leveling of machine 100 on a surface 120 in accordance with the teachings of the disclosure. The method may be practiced with more or less than the number of steps shown and is not limited to the order shown.

In step 402, the controller 132 receives a first all-leg raise signal when the cold planer 100 is in non-milling operational status and the grade and slope system 142 is off. In one embodiment, the controller 132 may have previously received a status signal indicating that the machine 100 is in such a non-milling operational status. In another embodiment, such an all leg-raise signal may not be allowed to be transmitted from the operator interface 138 to the controller 132 unless the machine 100 is in non-milling operational status and the grade and slope system 142 is off.

The all-leg raise signal (or the all-leg lower signal discussed later) may be received from a switch, button or other mechanism (collectively, a "switch") activated by the operator on the operator interface 138. For example, a two position return to center momentary rocker switch may be utilized. Pushing the switch upward may send an all-leg raise signal from the operator interface 138 to the controller 132 to raise the machine 100 by extending the legs 118. Pushing the switch downward may send an all-leg lower signal from the operator interface 138 to the controller 132 to lower the machine 100 by retracting the legs 118 of the machine 100.

In an alternative embodiment, a button arrangement may be utilized on the operator interface 138. Similar to the first embodiment, pushing a first button may send an all-leg raise signal from the operator interface 138 to the controller 132 to raise the legs 118 on the machine 100 and pushing second button on the operator interface 138 may send an all-leg lower signal to the controller 132 to lower the legs 118 on the machine 100. Other switch arrangements are also contemplated. In an exemplary method, the method steps for steps 402 to 410 may be executed as long as the switch on the operator interface 138 remains triggered and the controller 132 receives the first signal (for example, as long as the switch is held up or the button pressed).

In step 404, the controller 132 receives from each leg position sensor 122, data indicating the length L of the leg 118 (herein referred to as the "initial leg length"). In step 406, the controller 132 determines the longest initial leg length L for the plurality of legs 118 (hereinafter referred to as the "maximum initial leg length"). In one embodiment, the controller 132 may compare the initial leg length for each of the plurality of legs 118 and then select the greatest (longest) of the initial leg lengths as the maximum initial leg length.

In an alternative embodiment, the legs 118(*c-d*) of the rear support apparatuses 112*b* may be connected together hydraulically in a common hydraulic circuit as is known in the art, and the controller 132 may first calculate for this group of (rear) legs 118(*c-d*) an average initial leg length value and then compare this average value to the initial leg length received for each of the other legs 118 in the plurality of legs 118 to determine the maximum initial leg length for the entire plurality of legs 118 on the cold planer 100.

Once the maximum initial leg length has been determined by the controller 132, the controller 132 will transmit an activation command to the support apparatus 112 in step 408 to extend the legs 118 until the length of each of the plurality of legs 118 reaches the maximum initial leg length. At this point the length L of each of the plurality of legs 118 will be substantially equivalent and the method proceeds to step 410.

In step 410, the controller 132 transmits an activation command to the support apparatus 112 to extend the legs 118 to a first extension length. The controller 132 will transmit this activation command for as long as the switch on the operator interface 138 remains triggered (and the all-leg raise signal is received) or until a pre-service length has been achieved in step 410. The first extension length may be generally greater than or equal to about the maximum initial leg length or may be generally less than or equal to about the pre-service length. The pre-service length is a pre-defined leg 118 length at which the controller 132 will automatically cease extending the legs 118 in step 410. For example, the pre-service length may, in one embodiment, be about 50 mm below the service length. The service length is the greatest length to which the legs may be extended.

During step 410, the plurality of legs 118 may be raised at the same rate and the controller 132 may monitor the length L of each leg 118 to ensure that substantially equivalent leg lengths are maintained among the plurality of legs 118 while the legs 118 are being extended. When the operator stops triggering the all-raise switch on the operator interface 138 or the pre-service length is achieved, the controller 132 ceases extending the legs 118, the first extension length will have been reached and the method will proceed to step 412.

In an embodiment, the controller 132 may periodically or continuously receive leg length L information from the leg length sensors 122 to determine the present length of the legs 118 in order to determine whether the pre-service length has been achieved.

After the controller 132 stops extending the plurality of legs 118 in step 412, the controller 132 checks in step 414 to determine whether the first all-leg raise signal is still being received, or whether the operator has, within a given time period after reaching the pre-service length, re-activated the switch on the operator interface 138 to send another all-leg raise signal to the controller 132 and the switch has remained reactivated for a pre-defined minimum time period. If not, the method ends. Otherwise the method proceeds to step 416.

In step 416, the legs 118 are further extended to the service length. In one embodiment, as the legs 118 proceed to full service length, the sideplates 124 raise in relation to the frame 102 from a lowered to a fully raised sideplate position and the moldboard 126 raises in relation to the frame 102 from a lowered to a fully raised moldboard position. In some embodiments, at the conclusion of step 416, the sideplates 124 and moldboard 126 may lock into the raised position. After the full service length has been reached for the legs 118 in step 416, the method ends. In some machines, the sideplates 124 and moldboard 126 will take longer to fully raise than the time required for the legs to reach full service length. In such machines, the operator may need to continue to hold the raise command for a period of time after the legs reach full service height to allow the sideplates 124 and moldboard 126 to fully raise.

Figure 5:
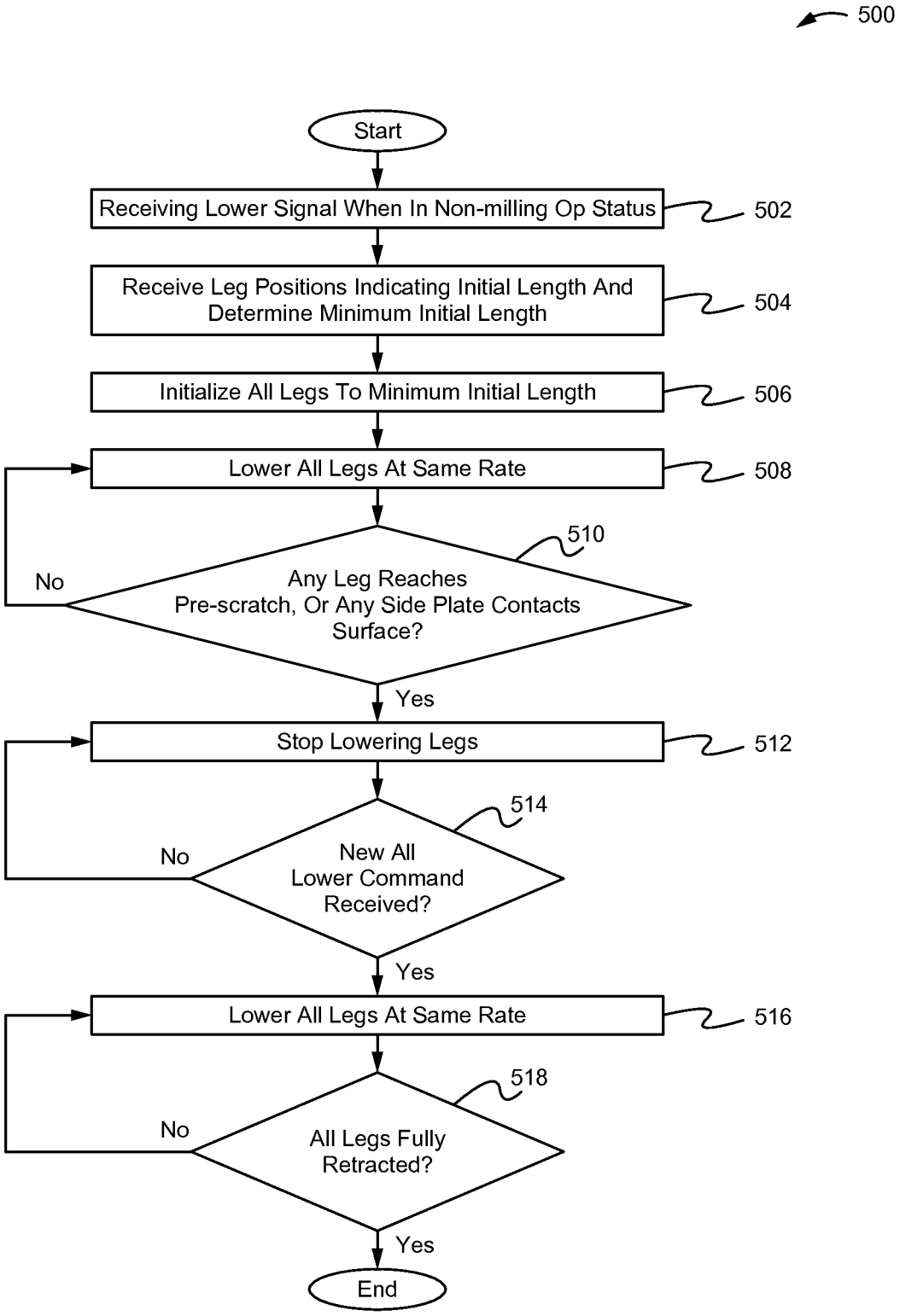
FIG. 5 is a flow chart illustrating an exemplary method for controlling the leveling of a machine on a surface in accordance with an example embodiment.

FIG. 5 illustrates an exemplary method 500 for controlling the leveling of a machine 100 on a surface 120 in accordance with the described principles. The method may be practiced with a greater or lesser number of steps than shown, and is not limited to execution in the order shown.

In step 502 of the illustrated process, the controller 132 receive an all-leg lower signal when the cold planer 100 is in non-milling operational status and the automatic grade and slope system 142 is off. In one embodiment, the controller 132 may have previously received a status signal from another controller or system indicating that the machine 100 is in such a non-milling operational status. In another embodiment, such an all leg-lower signal may not be allowed to be transmitted from the operator interface 138 to the controller 132 unless the machine 100 is in non-milling operational status and the grade and slope system 142 is off.

In step 504, the controller 132 receives from each leg position sensor 122, data indicating the initial leg length and determines the shortest initial leg length for the plurality of legs 118 (hereinafter referred to as the "minimum initial leg length"). In one embodiment, the controller 132 may compare the initial leg length for each of the plurality of legs 118 and then select the shortest initial leg length as the minimum initial leg length.

In an alternative embodiment, where the legs 118(*c-d*) of the rear support apparatuses 112*b* are connected together hydraulically in a common hydraulic circuit as is known in the art, the controller 132 may first calculate for this group of (rear) legs 118(*c-d*) an average initial leg length value and then compare this average value to the initial leg length received for each of the other legs 118 in the plurality of legs 118 to determine the minimum initial leg length for entire plurality of legs 118 on the cold planer 100.

At step 506, the controller 132 system initializes all legs 118 to the minimum initial length determined in step 504. At the conclusion of step 506, the length L of each of the plurality of legs 118 will be substantially equivalent. The legs 118 are then lowered from this point at the same rate at stage 508. As the legs 118 are lowered, if any leg reaches pre-scratch height or any sideplate contacts the surface, as determined at step 510, the controller 132 ceases lowering the legs 118 at stage 512. Otherwise, the lowering of the legs 118 continues and the check of length is repeated.

As will be appreciated by those of skill in the art, scratch length is the length L of the leg(s) 118 at which the lowest point of the tool 116 mounted on the machine 100, in this case the drum bits 131 attached to the drum 130, touch or scratch the surface 120. Pre-scratch length is the length of the legs 118 at which the lowest point of the tool 116 is a predetermined distance from touching or scratching the surface 120. For example, in one embodiment, the pre-scratch length may be the length L of the legs at which the drum bit 131 is about 5.1 cm above the surface. Other pre-scratch lengths are also contemplated.

If a new all lower command is received at step 514, then the process 500 flows to step 516 wherein the controller 132 continues to lower all legs 118 at the same rate. Otherwise, the process 500 loops back to step 512 and the legs 118 remain stationary. At stage 518, the controller 132 determines whether all legs 118 are fully retracted. If so, the process 500 terminates. Otherwise, the process 500 loops back to stage 516 and continues to lower all legs 118 at the same rate.

Figure 6:
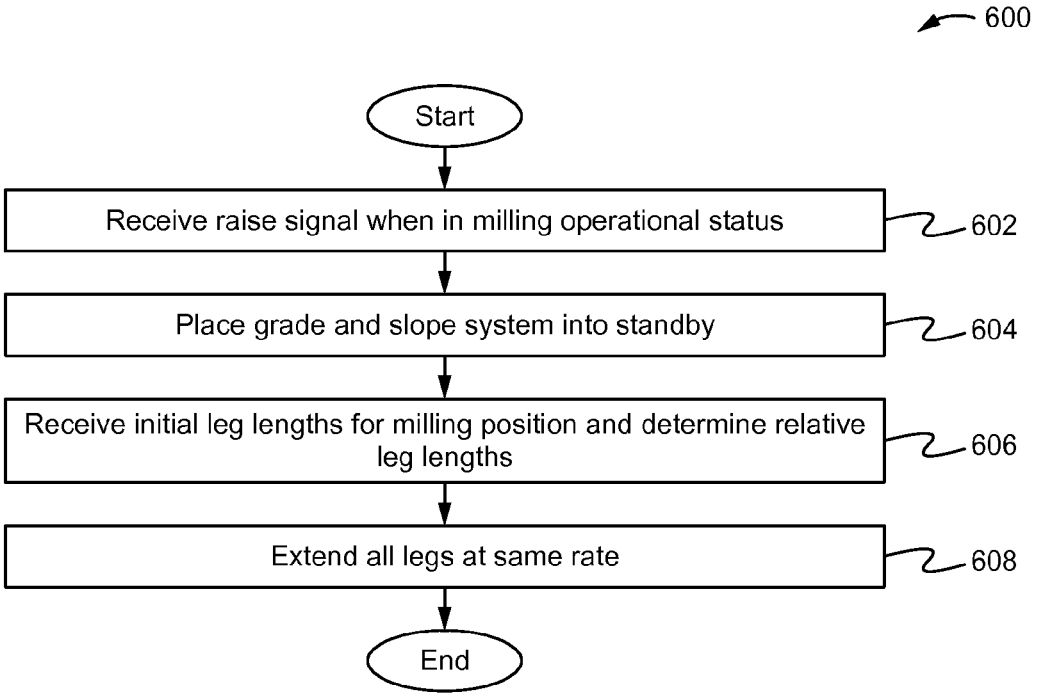
FIG. 6 is a flowchart illustrating exemplary steps of a method of controlling the vertical position of a tool mounted on a machine in accordance with the present disclosure.

FIG. 6 is a flow chart illustrating an exemplary method 600 for controlling the vertical position of a cold planer 100 in accordance with the teachings of this disclosure. The method may be practiced with more or less than the number of steps shown and is not limited to the order shown.

In step 602, the controller 132 may receive an all-leg raise signal when the cold planer 100 is in milling operational status. In one embodiment, the controller 132 may have previously received a status signal from another controller or system indicating that the machine 100 is in such milling operational status.

As discussed previously, the all-leg raise signal (or the all-leg lower signal discussed later) may be received from a switch activated by the operator on the operator interface 138. For example, a two position return to center momentary rocker switch may be utilized. Pushing the switch upward may send an all-leg raise signal from the operator interface 138 to the controller 132 to raise the legs 118. Pushing the switch downward may send an all-leg lower signal from the operator interface 138 to the controller 132 to lower the legs 118 of the machine 100. In an alternative embodiment, a button arrangement may be utilized on the operator interface 138. Pushing a first button may send an all-leg raise signal from the operator interface 138 to the controller 132 to raise the legs 118 on the machine 100 and pushing second button on the operator interface 138 may send an all-leg lower signal to the controller 132 to lower/retract the legs 118 on the machine 100. Other switch arrangements are also contemplated.

In step 604, the controller 132 transmits a signal to place the grade and slope system into standby mode. In step 606, the controller 132 receives from each leg position sensor 122, data indicating the initial leg length of the leg 118. Using the initial leg length data for each leg, the controller 132 determines the relative length of each leg 118 to the other legs 118 in the plurality.

In step 608, the controller 132 transmits an activation signal to the support apparatus 112 to raise the legs 118 for as long as the switch is triggered or until the pre-service length has been achieved. The plurality of legs 118 may be raised at the same rate and the controller 132 may monitor the length of each leg 118 to substantially ensure that the relative leg lengths are maintained while the legs 118 are being extended. In one embodiment, if at any time the operator stops triggering the all-raise switch (and the all-leg raise signal is no longer received by the controller 132) or pre-service length is achieved for at least one of the legs 118, the controller 132 will cease extending the plurality of legs 118 and the method ends. In an embodiment, the controller 132 may periodically or continuously receive leg length information from the leg position sensors 122 to determine the present length of the legs 118 in order to determine whether the pre-service length has been achieved.

Figure 7:
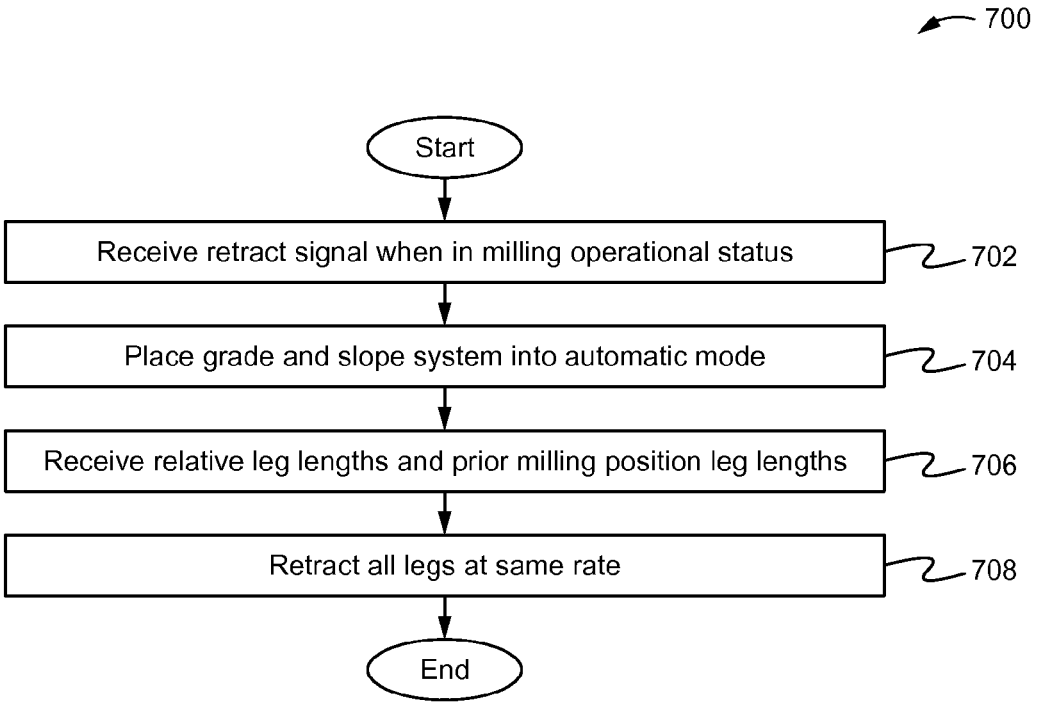
FIG. 7 is a flowchart illustrating exemplary steps of a method of controlling the vertical position of a tool mounted on a machine in accordance with the present disclosure.

FIG. 7 is a flow chart illustrating an exemplary method 700 for controlling the vertical position of a tool 116 mounted on a cold planer 100 in accordance with the teachings of this disclosure. The method 700 may be practiced with more or less than the number of steps shown and is not limited to the order shown.

In step 702, the controller 132 may receive an all-leg lower signal when the cold planer 100 is in milling operational status. In one embodiment, the controller 132 may have previously received a status signal from another controller or system indicating that the machine 100 is in such milling operational status. As discussed previously with regard to method 600, the all-leg lower signal may be received from a switch activated by the operator on the operator interface 138.

In step 704, the controller 132 transmits a signal to place the grade and slope system 142 into an automatic mode. In step 706, the controller 132 receives from each leg position sensor 122, data indicating the initial leg length of the leg 118. Using the initial leg length data for each leg, the controller 132 determines the relative length of each leg 118 to the other legs 118 in the plurality. The controller 132 also receives from the grade and slope system 142 the prior milling position length for each of the plurality of legs 118 during the last cut (the data is collectively, the "prior cut arrangement"). The prior milling position length for each leg 118 is the length to which that leg must be returned to in order for the tool to continue cutting with the same grade and slope as previously used.

In step 708, the controller 132 transmits an activation command to the support apparatus 112 to lower the legs 118 until the prior milling length has been achieved for each of the respective plurality of legs 118. In an embodiment, the controller may periodically or continuously receive leg length information from the leg sensors to determine the length L of the legs in order to determine whether the prior milling length has been achieved. The plurality of legs may be lowered at the same rate and the controller 132 may monitor the length of each leg to ensure that the relative leg lengths are maintained while the legs are being lowered.

The features disclosed herein may be particularly beneficial to cold planers and other vehicles that may need to be maintained level with a surface. In the non-milling operational status, the features disclosed herein improve stability of the machine for loading and unloading on a transportation vehicle, such as a truck or trailer, and/or during over-road travel of the machine. In the non-milling operational status, a level condition may be achieved quickly and automatically with the all-raise and all-lower feature without requiring an operator to individually adjust each leg visually or with instruments. In the milling operational status, the all-leg raise feature increases productivity and ease of operation by enabling the operator to quickly raise the machine out of a cut while keeping it level lengthwise. This may be particularly desirable when avoiding an obstacle such as a manhole cover or other object in a road surface. In the milling operational status, the all leg lower feature increases productivity and ease of operation by enabling the operator to quickly put the machine back into a cut while keeping it level lengthwise. This is desirable after an obstacle such as a manhole cover or other object in the road surface has been avoided.

What is claimed is:

1. A method of controlling the leveling of a machine on a surface, the machine including a frame supported by a plurality of legs and at least one sideplate mounted to the frame, the plurality of legs including first and second front legs and first and second rear legs, the method comprising:

receiving by a controller a first lower signal during non-milling operation to retract the plurality of legs;

determining the minimum initial leg length in the plurality of legs;

substantially leveling the machine with respect to the surface by retracting some of the plurality of legs to the minimum initial leg length; and further retracting all of the plurality of legs to a retraction length that is less than the minimum initial leg length.

2. The method of claim 1, wherein the retraction length is above scratch length.

3. The method of claim 1, further comprising halting the further retracting step if the sideplate contacts the surface.

4. The method of claim 3, further comprising continuing to lower the plurality of legs after the halting step if a second retracting signal is received by the controller.

5. The method of claim 4, wherein the continuing step occurs as long as the second retracting signal is received and full retraction length for each leg has not been achieved.

6. A machine for road work, the machine comprising:

a frame;

a plurality of ground engaging units, a plurality of vertically moveable legs, each leg connecting one of the plurality of ground engaging units to the frame; and a controller configured to, in response to a first signal received during non-milling machine operational status, activate some of the plurality of legs to move to a first length and then to activate all of the plurality of legs to move at the same rate to a second length, and upon receipt of a raise signal during milling operational status, extend all of the legs at the same rate from a first position to a second position and, upon receipt of a lower signal, to lower all of the legs at the same rate from the second position to the first position.

7. The machine of claim 6, wherein the first length is less than the second length.

8. The machine of claim 6, wherein the first length is greater than the second length.

* * * * *